US007658657B1

(12) United States Patent
Scanzillo et al.

(10) Patent No.: US 7,658,657 B1
(45) Date of Patent: Feb. 9, 2010

(54) SINGLE-POLE ELECTRICAL CONNECTOR HAVING A STEEL RETAINING SPRING

(75) Inventors: Thomas L. Scanzillo, Monroe, CT (US); Thomas W. Bracci, Trumbull, CT (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 12/379,706

(22) Filed: Feb. 26, 2009

(51) Int. Cl.
*H01R 11/22* (2006.01)

(52) U.S. Cl. ..... 439/825; 439/839

(58) Field of Classification Search ..... 439/825, 439/839
See application file for complete search history.

(56) References Cited

U.S. PATENT DOCUMENTS

| | | | | |
|---|---|---|---|---|
| 221,074 | A | 10/1879 | Knudson | |
| 1,383,040 | A | 6/1921 | Van Atten | |
| 2,851,670 | A | 9/1958 | Senior | |
| RE25,506 | E | 12/1963 | Stevens, Jr. | |
| 3,145,069 | A | 8/1964 | Damon | |
| 3,270,314 | A | 8/1966 | Kohanek | |
| 3,478,305 | A | 11/1969 | Chirumbolo | |
| 3,681,742 | A | 8/1972 | Newman | |
| 3,689,866 | A | 9/1972 | Kelly | |
| 3,715,708 | A * | 2/1973 | Lloyd et al. | 439/675 |
| 3,851,946 | A | 12/1974 | Piaget | |
| 4,374,607 | A | 2/1983 | Bright | |
| 4,405,195 | A * | 9/1983 | Cherry et al. | 439/825 |
| 4,483,281 | A | 11/1984 | Black | |
| 4,526,429 | A * | 7/1985 | Kirkman | 439/82 |
| 4,752,253 | A * | 6/1988 | Neumann et al. | 439/825 |
| 4,767,349 | A | 8/1988 | Pottier | |
| 4,810,213 | A * | 3/1989 | Chabot | 439/825 |
| 5,423,692 | A | 6/1995 | Francis | |
| 5,575,694 | A | 11/1996 | Hawkins | |
| 5,904,599 | A * | 5/1999 | Miller et al. | 439/827 |
| 6,039,614 | A | 3/2000 | Ramari | |
| 6,071,145 | A | 6/2000 | Toly | |
| 6,074,236 | A * | 6/2000 | Wu | 439/378 |
| 6,955,569 | B2 * | 10/2005 | Baker et al. | 439/839 |
| 7,077,681 | B2 | 7/2006 | Behoo | |

* cited by examiner

*Primary Examiner*—Gary F. Paumen
(74) *Attorney, Agent, or Firm*—Alfred N. Goodman; Mark S. Bicks; Marcus R. Mickney

(57) ABSTRACT

A male plug of a single-pole electrical connector assembly includes a non-conductive housing and a conductive contact having first and second ends disposed in the housing. The first end is adapted to receive an electrical cable and the second end is adapted to engage a corresponding female contact. An axially extending slot is formed in the contact and extends toward the first end of the contact from the second end. The slot forms first and second slotted portions of the contact. A spring disposed proximal the second end of the contact substantially prevents yielding of the first and second slotted portions of the contact and biases the first and second slotted portions radially outwardly.

20 Claims, 4 Drawing Sheets

SINGLE-POLE ELECTRICAL CONNECTOR HAVING A STEEL RETAINING SPRING

FIELD OF THE INVENTION

The present invention relates to a male plug of a single-pole electrical connector. More particularly, the present invention relates to a spring connected to a slotted male plug of a single-pole electrical connector. Still more particularly, the present invention relates to a retainer spring disposed in an end of a slotted male plug of a single-pole electrical connector, thereby substantially preventing yielding of the slotted portions of the male plug.

BACKGROUND OF THE INVENTION

Single-pole electrical connectors are typically used for supplying temporary electrical power and are configured to connect and disconnect quickly and easily. The single-pole electrical connectors include a male plug having a pin and a female contact having a sleeve. The male plug and female contact are generally rated for 600 volts max and up to 400 amps max.

The contact of the male plug and the sleeve of the female contact are high conductivity brass contacts that are disposed within non-conductive housings. Non-conductive retaining screws are used to secure the contact and sleeve within their respective housings.

The male contact is slotted to provide the contact of the male plug with spring-like properties, which facilitates mating and engagement with the female contact. The spring-like properties also ensure proper engagement with the female contact for the transmission of electrical power. Inadequate spring force or yielding springs on the slotted male contact decreases the electrical transmitting capabilities of the electrical connectors and results in high thermal temperatures of mated connectors. The spring force of the slotted male contact yields over time due to repeatedly connecting and disconnecting the male plug to and from the female contact. Accordingly, a need exists for a slotted male contact that does not yield over time.

Thus, there is a continuing need to provide improved male plugs for single-pole electrical connector assemblies.

SUMMARY OF THE INVENTION

Accordingly, it is a primary objective of the present invention to provide a male contact of a male plug of a single-pole electrical connector assembly that does not substantially yield or fatigue after numerous connections.

Another objective of the present invention is to provide an improved male plug for a single-pole electrical connector assembly in which a slotted contact of the male plug has a retainer spring.

A further objective of the present invention is to provide a slotted male contact with a retainer spring to substantially prevent yielding or fatiguing of the contact.

A still further objective of the present invention is to provide a retainer spring swaged to the contact to substantially prevent axial movement of the retainer spring.

Another objective of the present invention is to provide a slotted male contact of a male plug with a retainer spring to substantially prevent decreased electrical transmitting capabilities and increased thermal temperatures of the single-pole electrical connector assembly.

The foregoing objectives are basically attained by a male plug of a single-pole electrical connector assembly that includes a non-conductive housing and a conductive contact having first and second ends disposed in the housing. The first end is adapted to receive an electrical cable and the second end is adapted to engage a corresponding female contact. An axially extending slot is formed in the contact and extends toward the first end of the contact from the second end. The slot forms first and second slotted portions of the contact. A spring disposed proximal the second end of the contact substantially prevents yielding of the first and second slotted portions of the contact.

The foregoing objectives are also basically attained by a single-pole electrical connector assembly including a male plug and a female contact adapted to receive the male plug. The male plug includes a non-conductive housing and a conductive contact having first and second ends disposed in the housing. The first end is adapted to receive an electrical cable and the second end is adapted to engage the female contact. An axially extending slot is formed in the contact and extends toward the first end of the contact from the second end. The slot forms first and second slotted portions of the contact. A spring disposed proximal the second end of the contact substantially prevents yielding of the first and second slotted portions of the contact.

Other objects, advantages and salient features of the invention will become apparent from the following detailed description, which, taken in conjunction with the annexed drawings, discloses a preferred embodiment of the invention.

As used in this application, the terms "front," "rear," "side," "upper," "lower," "upwardly," "downwardly," "rearwardly" and other orientational descriptors are intended to facilitate the description of the single pole electrical connector assembly, and are not intended to limit the structure of the single-pole electrical connector assembly to any particular position or orientation.

BRIEF DESCRIPTION OF THE DRAWINGS

The above aspects and features of the present invention will be more apparent from the description for an exemplary embodiment of the present invention taken with reference to the accompanying drawings, in which.

Throughout the drawings, like reference numerals will be understood to refer to like parts, components and structures.

DETAILED DESCRIPTION OF EXEMPLARY EMBODIMENTS

Figure 1:
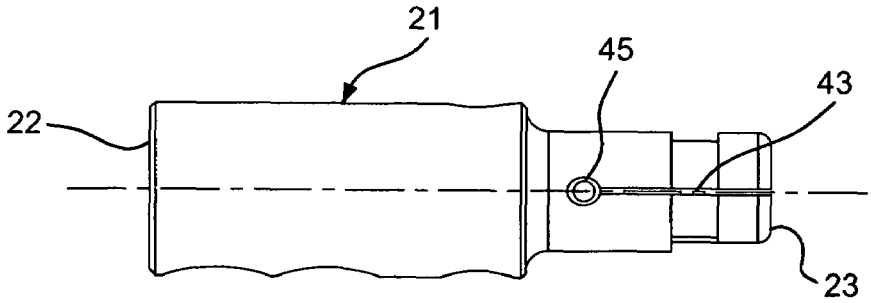
FIG. 1 is a side elevational view of a contact for a male plug of a single-pole electrical connector assembly according to an exemplary embodiment of the present invention.

As shown in FIGS. 1-11, the present invention includes a single-pole electrical connector assembly 11. A retainer spring 61 substantially prevents slotted portions 47 and 49 of a male contact 21 of a male plug 19 from yielding or fatiguing, thereby facilitating the electrical transmission capabilities of the single-pole electrical connector assembly 11 as well as substantially preventing high thermal temperatures from occurring due to a poor connection between the male plug 19 and female contact 13 of the single-pole electrical connector assembly.

Figure 6:
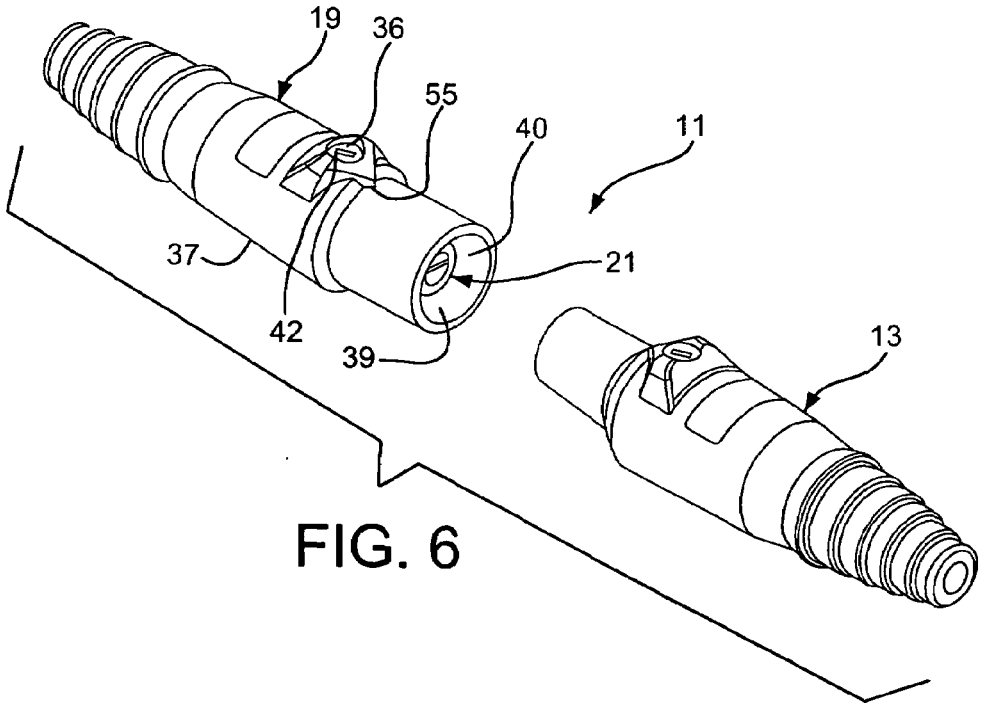
FIG. 6 is a perspective view of the connector assembly prior to the male plug being connected to a female contact.
Figure 7:
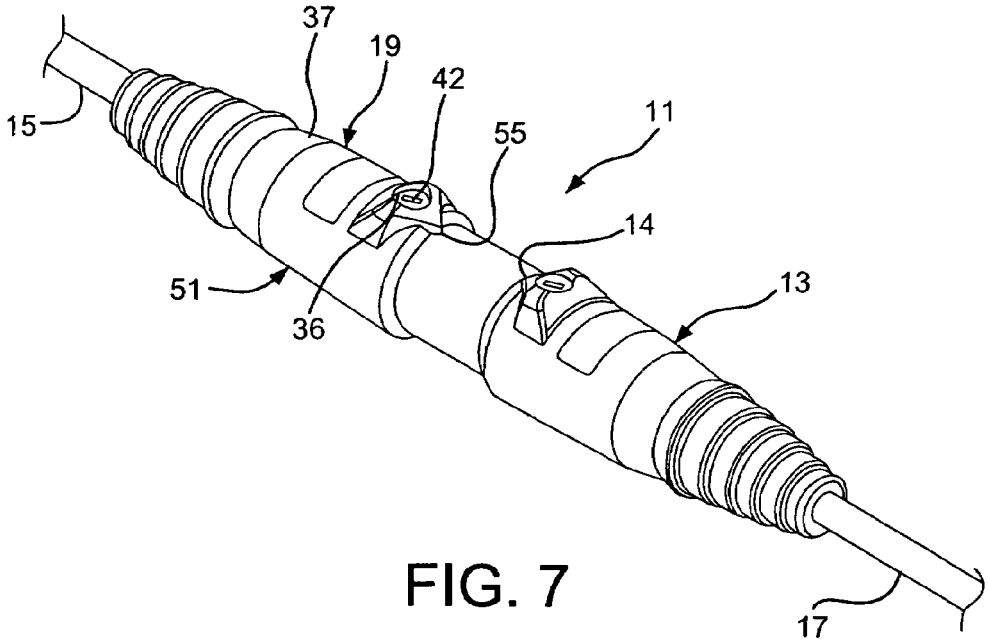
FIG. 7 is a perspective view of the connector assembly with the male plug connected to the female contact of FIG. 6.
Figure 8:
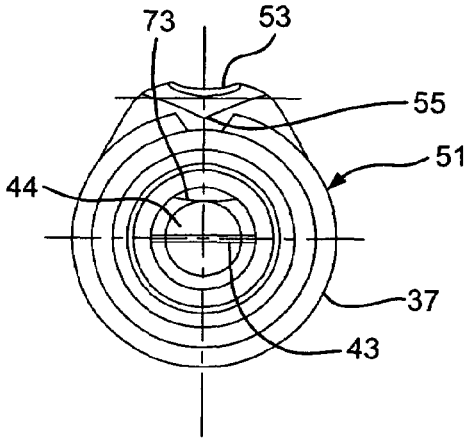
FIG. 8 is a front elevational view of the male plug of FIG. 5 without the retainer spring.

The single-pole electrical connector assembly 11, as shown in FIGS. 6 and 7, includes a male plug 19 and a female contact 13. Electrical cables 15 and 17 are connected to the male plug 19 and female contact 13, respectively. Connecting the male plug 19 and female contact 13, as shown in FIG. 7, enables the transmission of electrical power therethrough.

The male contact 21, as shown in FIGS. 1-4 and 8-11, has a first end 22 and a second end 23. A cable 15 (FIG. 7) is connected to the first end 22 of the male contact 21. The second end 23 is adapted to engage a corresponding female contact 13 (FIG. 7). The male contact 21 has a rear portion 31 and a front portion 41 connected thereto. A cavity 32 is formed in the rear portion 31 to receive the electrical cable 15. A first opening 35 is formed in the rear portion 31 to receive a housing retaining fastener 36 that secures the male contact 21 to a housing 51. Second and third openings 33 and 34 are formed in the rear portion 31 and extend into the cavity 32. Fasteners (not shown) are received by the openings 33 and 34 to secure the cable 15 within the cavity 32.

The front portion 41 is generally cylindrical. A slot 43 extends from the second end 23 of the male contact 21 rearwardly toward the rear portion 31 of the contact. An opening 45 is formed at the rear end of the slot 43 and extends completely through the front portion 41 of the contact 21, thereby providing stress relief in the contact. The slot 43 forms first and second slotted portions 47 and 49 of the front portion 41 of the contact 21, thereby providing the slotted portions 47 and 49 with spring-like or resilient properties to facilitate connecting the male plug 11 with the female contact 13. A recessed face 44 is formed at the second end 23 of the contact 21.

Figure 2:
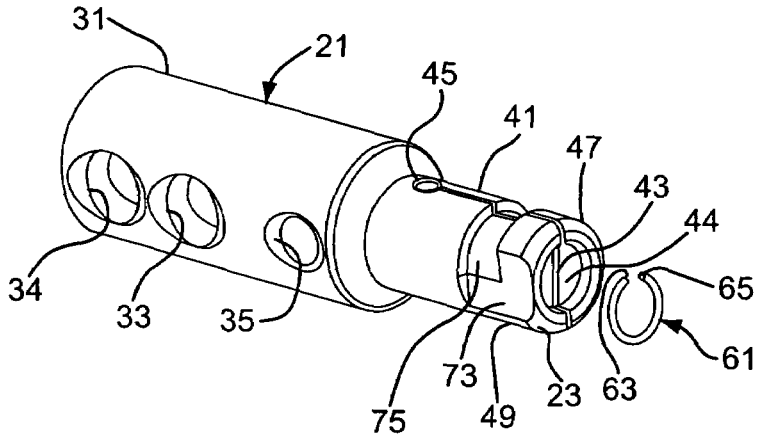
FIG. 2 is a perspective view of a contact for a male plug of a single-pole electrical connector assembly prior to having a retainer spring connected thereto.
Figure 9:
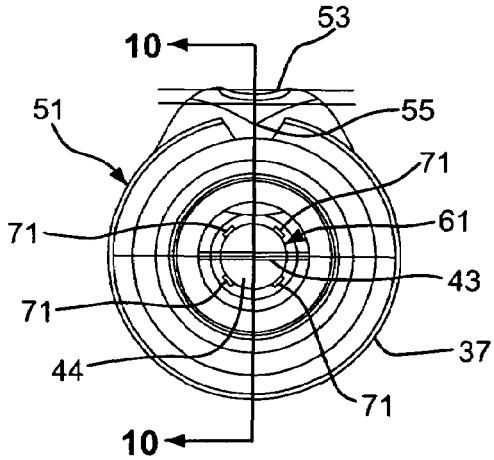
FIG. 9 is a front elevational view of the male plug of FIG. 5 with the retainer spring connected thereto.
Figure 10:
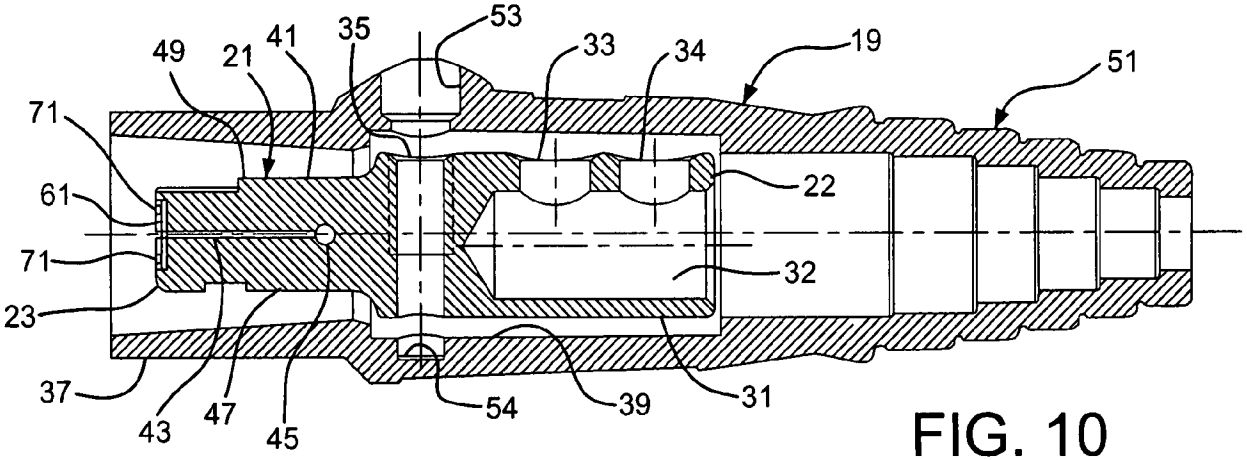
FIG. 10 is a side elevational view in cross section taken along line 10-10 of FIG. 9 of the male contact with the retainer spring connected thereto.
Figure 11:
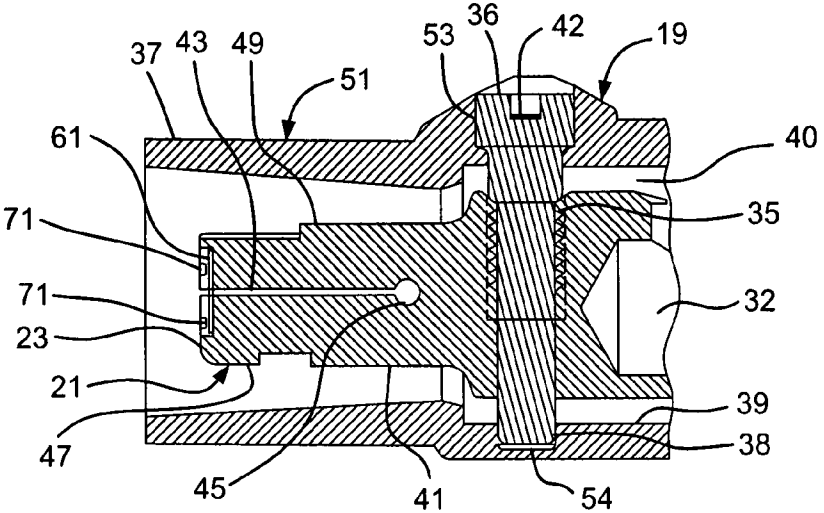
FIG. 11 is an enlarged, partial side elevational view in cross section of the male contact of FIG. 10 in which a housing retaining fastener secures the contact to the housing.

A split retaining ring 61 is disposed proximal the recessed face 44 of the contact 21, as shown in FIGS. 9-11. The retaining ring 61 is substantially circular in shape, as shown in FIG. 2, and preferably has two non-contacting ends 63 and 65. Once the retaining ring 61 is disposed proximal the recessed face 44, at least one portion 71 of the second end 23 of the contact 21 is swaged to secure the retaining ring 61 to the contact, thereby substantially preventing axial movement of the retaining ring. As shown in FIG. 9, preferably four swaged portions 71 secure the retaining ring 61 to the contact 21. With the retaining ring 61 secured to the contact 21, the first and second slotted portions 47 and 49 are substantially prevented from yielding or fatiguing, i.e., moving closer together, to impair the connection between the male plug 19 and the female contact 13 by the ring 61 biasing portions 47 and 49 radially or laterally outwardly. Alternatively, the second end 23 of the contact 21 may be swaged to substantially prevent both axial and rotational movement of the retaining ring 61.

The male contact 21 is disposed within a cavity 40 in a housing 51 (FIG. 5), as shown in FIGS. 6-11. The housing 51 has an outer surface 37 and an inner surface 39. An opening 53 in the housing 51 is adapted to receive the fastener 36 to secure the contact 21 to the housing. The opening 53 extends from the outer surface 37 to the housing cavity 40. A recess 54 in an inner surface 39 of the housing 51 opposite and aligned with the opening 53 receives an end 38 of the fastener 36. A slot 42 in the fastener 36 allows the fastener to be inserted and removed with a tool.

The front portion 41 of the male contact 21 has a flat portion 73 connected to a circumferentially extending groove 75 adapted to be received by a tab of the female contact 13 to lock the male plug 19 to the female contact 13. An arrow 55 proximal the opening 53 on the outer surface 37 of the housing 51 is aligned with a corresponding arrow 14 on the female contact 13 when the male plug and female contact are properly connected, as shown in FIG. 7.

The male contact 21 is made of a conductive material, such as a copper alloy or brass. The housing 51 is made of a non-conductive material, such as a thermoplastic elastomer (TPE). The retaining fastener 36 is made of a non-conductive material, such as nylon. The retaining spring 61 is preferably made of steel.

Assembly and Operation

Figure 3:
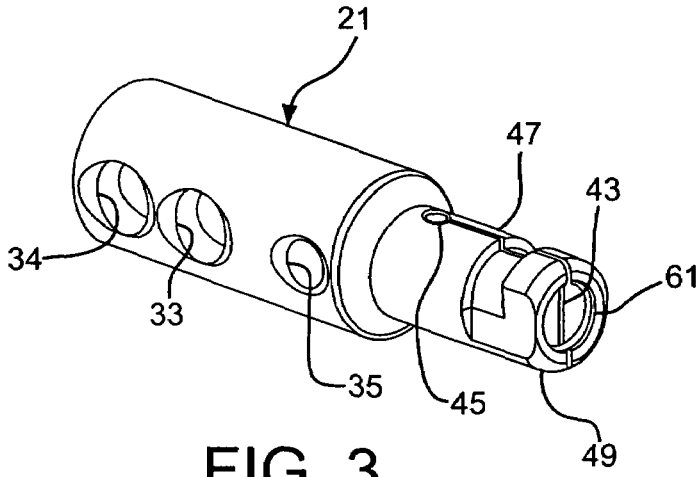
FIG. 3 is a perspective view of the contact of FIG. 2 with the retainer spring connected thereto.
Figure 4:
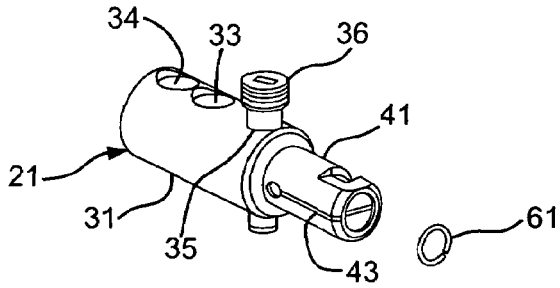
FIG. 4 is a perspective view of the contact of FIG. 2 prior to connecting the retainer spring thereto and with a housing retaining fastener disposed therein.
Figure 5:
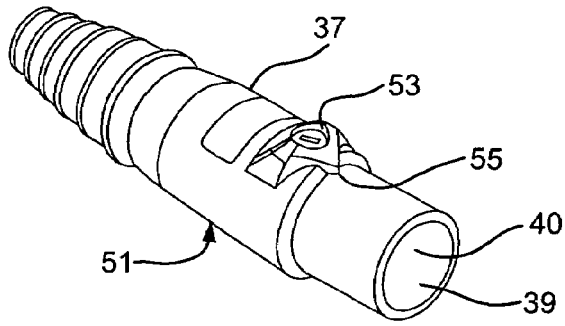
FIG. 5 is a perspective view of a housing for a male plug of a single-pole connector assembly.

To assemble male plug 19, the retaining ring 61 is disposed adjacent the front face 44 of the front portion 41 of the male contact 41, as shown in FIG. 3. At least one portion 71 of the second end 23 of the contact 21 is swaged to secure the retaining ring 61 to the contact to substantially prevent axial movement of the retaining ring, as shown in FIGS. 9-11. The retaining ring 61 substantially prevents the first and second slotted portions 47 and 49 from yielding, i.e., moving closer together, thereby facilitating electrical and mechanical connections.

The housing 51 is disposed over the end of an electrical cable 15, which is then bundled and inserted in the first end 22 of the male contact 21 in a conventional manner. Fasteners (not shown) are then inserted through openings 33 and 34 to secure the electrical cable 15 to the male contact 21.

The housing 51 is then slid over the male contact 21 such that the opening 53 in the housing 51 is aligned with the opening 35 in the male contact 21, as shown in FIG. 10. A fastener 36 is then passed through the openings 53 and 35 to secure the male contact 21 within the housing 51. A slot 42 in the fastener 36 facilitates inserting and withdrawing the fastener from the openings 53 and 35. The end 38 of the fastener 36 is received by the recess 54 disposed on the inner surface 39 of the housing diametrically opposite the opening 53.

The single-pole electrical connector assembly 11 is assembled by connecting the male plug 19 to the female contact 13, as shown in FIGS. 6 and 7. The male plug 19 is inserted in the female contact 13 such that a tab disposed within the female contact passes over the flat portion 73 of the male contact 21. The male contact 21 is then rotated such that the tab of the female contact 13 is received by the groove 75, thereby mechanically and electrically connecting the male plug 19 to the female contact 13 as shown in FIG. 7. When the male plug 19 and female contact 13 are properly connected, the arrow 55 of the male plug 19 is aligned with an arrow 14 of the female contact 13.

While one advantageous embodiment has been chosen to illustrate the invention, it will be understood by those skilled in the art that various changes and modifications may be made therein without departing from the scope of the invention as defined in the appended claims.

What is claimed is:

1. A male plug of a single-pole electrical connector assembly, comprising:

a non-conductive housing;

a conductive contact having first and second ends disposed in said housing, said first end being adapted to receive an electrical cable and said second end being adapted to engage a corresponding female contact;

an axially extending slot formed in said contact and extending toward said first end of said contact from said second end, said slot forming first and second slotted portions of said contact; and a spring disposed proximal said second end of said contact to substantially prevent yielding of said first and second slotted portions of said contact and to bias said first and second slotted portions radially outwardly.

2. A male plug of a single-pole electrical connector assembly according to claim 1, wherein said slot passes diametrically completely through said contact.

3. A male plug of a single-pole electrical connector assembly according to claim 1, wherein a hole is formed at an end of said slot.

4. A male plug of a single-pole electrical connector assembly according to claim 3, wherein said hole passes completely through said contact.

5. A male plug of a single-pole electrical connector assembly according to claim 1, wherein said spring is made of steel.

6. A male plug of a single-pole electrical connector assembly according to claim 1, wherein said spring has non-contacting first and second ends.

7. A male plug of a single-pole electrical connector assembly according to claim 1, wherein said second end of said contact is swaged to substantially prevent axial movement of said spring.

8. A male plug of a single-pole electrical connector assembly according to claim 1, wherein a fastener secures said contact to said housing.

9. A male plug of a single-pole electrical connector assembly according to claim 8, wherein said fastener is disposed rearwardly of said slot.

10. A male plug of a single-pole electrical connector assembly, comprising:

a non-conductive housing;

a conductive contact having first and second ends disposed in said housing, said first end being adapted to receive an electrical cable and said second end being adapted to engage a corresponding female contact;

an axially extending slot formed in said contact and extending toward said first end of said contact from said second end, said slot extending diametrically completely through said contact and forming first and second slotted portions of said contact;

a hole formed at an end of said slot spaced from said second end of said contact, said hole passing completely through said contact;

a spring disposed proximal said second end of said contact to substantially prevent yielding of said first and second slotted portions of said contact and to bias said first and second slotted portions radially outwardly; and a fastener securing said contact to said housing.

11. A male plug of a single-pole electrical connector assembly according to claim 10, wherein said spring is made of steel.

12. A male plug of a single-pole electrical connector assembly according to claim 10, wherein said spring has non-contacting first and second ends.

13. A male plug of a single-pole electrical connector assembly according to claim 10, wherein said second end of said contact is swaged to substantially prevent axial movement of said spring.

14. A male plug of a single-pole electrical connector assembly according to claim 10, wherein said contact is made of a copper alloy.

15. A single-pole electrical connector assembly, comprising:

a female contact;

a male plug adapted to engage said female contact, said male plug including a non-conductive housing;

a conductive contact having first and second ends disposed in said housing, said first end being adapted to receive an electrical cable and said second end being adapted to engage said female contact;

an axially extending slot formed in said contact and extending toward said first end of said contact from said second end, said slot forming first and second slotted portions of said contact; and a spring disposed proximal said second end of said contact to substantially prevent yielding of said first and second slotted portions of said contact and to bias said first and second slotted portions radially outwardly.

16. A single-pole electrical connector assembly according to claim 15, wherein said slot passes diametrically completely through said contact.

17. A single-pole electrical connector assembly according to claim 15, wherein a hole is formed at an end of said slot.

18. A single-pole electrical connector assembly according to claim 17, wherein said hole passes completely through said contact.

19. A single-pole electrical connector assembly according to claim 15, wherein said spring is made of steel.

20. A single-pole electrical connector assembly according to claim 15, wherein said second end of said contact is swaged to substantially prevent axial movement of said spring.

* * * * *